US005489911A

United States Patent [19]

Gordon et al.

[11] Patent Number: 5,489,911

[45] Date of Patent: Feb. 6, 1996

[54] MARINE VHF ANTENNA SYSTEM AND METHOD

[76] Inventors: Theodore J. Gordon, 23 Starfish Rd., Vero Beach, Fla. 32960; Thomas A. Gordon, 164 Great Pond Rd., South Glastonbury, Conn. 06073

[21] Appl. No.: 235,458

[22] Filed: Apr. 29, 1994

[51] Int. Cl.[6] ..... H01Q 1/34

[52] U.S. Cl. ..... 343/709; 343/878; 343/882

[58] Field of Search ..... 343/709, 878, 343/887, 888, 882; 114/105; 174/138 A; H01Q 1/34, 1/12

[56] References Cited

U.S. PATENT DOCUMENTS 3,082,470 3/1963 Fork ..... 174/153 G

FOREIGN PATENT DOCUMENTS 61-88602 5/1986 Japan ..... H01Q 1/18

8105622 7/1983 Netherlands ..... 343/709

*Primary Examiner*—Donald T. Hajec
*Assistant Examiner*—Hoanganh Le
*Attorney, Agent, or Firm*—Carroll F. Palmer

[57] ABSTRACT

Improved marine VHF radio antennas systems are provided that can be installed on sailboats to position a whip antenna or other radiation unit aloft from the boat deck, even while underway. The antenna system includes an elongated flexible plastic extrusion that internally carries the coaxial cable for the radiation unit and has a longitudinal channel accessed through a side slit. The radiation unit when slideably installed on the boat's backstay is then carried aloft on the backstay as the extrusion is threaded on it via the side slit until the extrusion channel is completely filled by the backstay. The system is completed by electrical connection of the lower end of the coaxial cable to a hand held, battery operated transceiver or other electronic device.

16 Claims, 3 Drawing Sheets

MARINE VHF ANTENNA SYSTEM AND METHOD

BACKGROUND OF THE INVENTION

1. Field of the Invention

This application relates to marine VHF radio antennas. More particularly, it concerns novel type of antennas that can be used with marine hand held transceivers operating in the VHF band and particularly aboard sailboats.

2. Description of the Prior Art

A typical VHF radio installation on a sailboat consists of a quarter wave whip mounted on top of the sailboat's mast. A long length of low impedance coaxial cable runs down through the mast and connects the antenna to the ship's VHF radio. This arrangement provides the greatest transmitting and receiving range since VHF transmission is largely line of sight. The power level of marine VHF transceivers is typically 25 watts, the maximum allowed by the FCC.

There are several disadvantages inherent in mast mounted antenna systems. These include (a) changes in antenna pattern and concomitant changes in range that occur with roll, heel and pitch, (b) need to go to the top of the mast to affect repairs to the antenna, (c) loss of communications in the case of catastrophic mast failure, (d) permanent installation that is not movable from boat to boat, (e) difficulty of installation, particularly the coaxial lead inside the mast, and (f) need to remove the antenna at lay up.

Many mariners have augmented their primary ship's VHF radio with a hand held portable walkie-talkie type VHF radio. This type of radio is usually self contained and utilizes a telescoping or "rubber ducky" antenna that does not require any antenna installation on the boat. The FCC limits transmit power on such radios to 6 watts. These hand held radios have gained tremendous popularity recently due to their portability, but hand held radios suffer from an extremely short range, primarily as a result of the low height of the antenna.

Hand held transceivers also may involve a potential health risk due to RF exposure close to the users' head.

One might consider connecting a hand held radio to a mast-top mounted antenna, as a solution to many of the problems outlined here. A single mast-top antenna installation with a VHF switch between the primary radio and the hand held radio would allow use of either radio, but this solution is cumbersome. An alternate is the addition of a second permanently mounted antenna at mast-top, but this requires duplicate antennas and feedlines plus installation of a feedline to the cockpit where hand held radios are most often used.

Alternatively, one could hoist an antenna mounted to a length of coaxial cable up the ship's mast taking advantage of one of the ship's sail hoisting halyards. This is a temporary solution at best and will be noisy due to the slapping of the cable in the wind (leading to premature failure) and may interfere with the handling of the boat since it uses some of the boats primary equipment.

The present invention addresses the problems associated with prior known VHF marine radios and their antennas as discussed above and provides new improvements in VHF antennas that mitigate or entirely eliminate them.

The forestays and backstays of sailboats, in addition to acting as rigging for the mast, have been used in a variety of ways to provide columnar support to auxiliary items used aboard sailboats. Typically, the forestay provides support for the luffs of jib sails via snap-hanks. Recently, multi-grooved, elongated plastic extrusions have been used as clip-on leads to support jib luffs to the forestays in place of snap-hanks, e.g., see U.S. Pat. No. Re. 31,829.

As to backstays, a recent example of their use as vertical support for an auxiliary item aboard a sailboat is as a mount for a radar antenna, see U.S. Pat. No. 5,111,212.

The present invention utilizes the backstay of sailboats in an new manner to provide columnar support to its improved VHF radio antennas.

OBJECTS

A principal object of the invention is the provision of new improvements in marine VHF radio antennas, particularly such antennas that can be used in combination with marine hand held transceivers operating in the VHF band aboard sailboats.

A further object is to reduce the potential health hazard associated with proximity to transmitting antennas, while preserving much of the portability enjoyed by current hand held radios.

Further objects include the provision of:

1. Means to improve the communication distances of hand held VHF transceivers.
2. Means to eliminate changes in the transmission radiation pattern as the boat rolls, pitches and heels.
3. An inexpensive substitute for the primary antenna aboard a sailboat, particularly in the case of an emergency.
4. A unique method to raise an antenna aloft aboard a sailboat without need (1) to ascend the mast, (2) to use any of the boat's hoisting halyards or (3) to remove any rigging.
5. VHF antennas that can be erected aboard sailboats while they are underway.

Other objects and further scope of applicability of the present invention will become apparent from the detailed descriptions given herein; it should be understood, however, that the detailed descriptions, while indicating preferred embodiments of the invention, are given by way of illustration only, since various changes and modifications within the spirit and scope of the invention will become apparent from such descriptions.

SUMMARY OF THE INVENTION

The objects are accomplished in accordance with the invention by the provision of new improved forms of marine VHF radio antennas that utilize full size quarter wave length radiating elements for use in combination with hand held, portable VHF transceivers.

In the new antennas, a semi-flexible plastic extrusion is used to attach the coaxial cable to the backstay and locates the coax parallel to the backstay. The extrusion may look like a figure eight with a slit opening at the top and bottom of the figure eight. One loop of the figure eight envelops the coaxial cable along the length of the extrusion, and the other section of the extrusion is used to hold the assembly to the back stay. The coaxial cable/extrusion assembly is fed onto the back stay from the ship's deck and slid up the stay until sufficient length is installed. The backstay itself provides the required column stiffness for this installation which is accomplished by a person standing on the boats deck.

The length of the flexible, plastic extrusion is typically 30–50 feet for a 35 foot long boat. Alternatively, two or more separate sections of extrusion structured in accordance with the invention may be use to form the "column" for the new antenna systems.

In a preferred embodiment, the extrusion is co-extruded with the coaxial cable for a simpler assembly. This embodiment of extrusion contains a single chamber running its length to capture the backstay.

Once the extrusion with its enclosed coaxial cable is installed, it may be held in place with clips, cable clamps, or hose clamps capturing it and the back stay at the bottom. This will prevent the assembly from "walking" up or down the backstay. The extrusion and cable will remain fixed since they are held in column mode while attached to the backstay. As an alternative, the clamp may be placed around the backstay just below the extrusion in order to keep it from slipping down from its desired position.

The bottom end of the coax terminates with an appropriate VHF antenna connector, and the top (or antenna) end of the assembly may terminate in several alternative ways.

The simplest antenna of the invention is a dipole. One element of the antenna projects forward from the extrusion and the other, aft, parallel to the backstay. This parallel orientation is not ideal electrically: it may distort the radiation pattern (isotropic in a horizontal plane is desirable) and may cause an impedance mismatch.

While a vertically oriented antenna produces a better radiation pattern and match, twisting of the backstay or of the extrusion would cause the antenna to leave its vertical position or even project vertically downward. In this position, the antenna radiating element might hit the sail on some boats during maneuvers in which the sail moves across the backstay.

Orienting the antenna parallel to the backstay avoids this problem. This antenna will be of low impedance, but a matching network may be built-into the antenna radiating element base should matching be found necessary. The antenna will be integral to the extrusion, co-extruded, held on the surface mechanically or with adhesives.

In a first preferred embodiment of the invention, the new antenna comprises a gimbaled whip which is electrically connected to the top of the coax and mechanically supported by the top of the extrusion. This antenna assembly consists of a vertical plate of some non-conductive plastic material such as nylon or acetyl resin. The plate contains a slit leading to a circular hole which permits it to be placed over the backstay before the installation of the co-extrusion holding the coax. The vertical antenna radiating element, ground counterpoises, and a counterweight are mounted to the plate. The counterweight may also serve as the counterpoise through appropriate choice of heavy materials.

The radiating element and counterpoises are electrically connected to the coax through slack flexible electrical wires. In this configuration, the antenna remains vertical during rolling, heeling and pitching of the boat, the radiation pattern is generally isotropic in the horizontal plane, the impedance of the antenna is a good match to the coax, and twisting of the backstay and extrusion, at least through a limited range, has no affect on the antenna, either mechanically or electrically.

In a second, preferred embodiment, the antenna is mounted to a gimbaled ball that is pushed into place aloft on the backstay by the extrusion assembly. The bore in the ball is of a diameter that permits the ball to rotate about the axis of the back stay, thus creating the principal axis of rotation (the roll axis) of the gimbal. The ball also includes a feature which serves as a strain relief for the coaxial cable. This may be nothing more than a secondary bore in the plane of the split, on a parallel off axis to the primary bore of the sphere.

The secondary axis of the gimbal, the pitch axis, is created by the attachment of a cage surrounding the sphere that is free to pivot about a horizontal axis. An antenna whip mount on top of the cage and an emerging coax is securely clamped in place within the sphere with a service loop of sufficient length to prevent binding during motion of the assembly. Below the sphere, attached to the cage mounts a counter balance weight and counterpoises. This gimbaled assembly assures that the antenna whip is always oriented in a vertical orientation regardless of angle of heel or degree of pitch. The counterweight may serve also as the counterpoise through appropriate choice of heavy materials.

With this new antenna and mounting arrangement of the invention, it is possible to operate an inexpensive, easily installed, removable VHF antenna high aloft thus giving far superior performance to current hand held radios with less health risk.

BRIEF DESCRIPTION OF THE DRAWINGS

A more complete understanding of the invention can be obtained by reference to the accompanying drawings in which.

DESCRIPTION OF THE PREFERRED EMBODIMENTS

Figure 1:
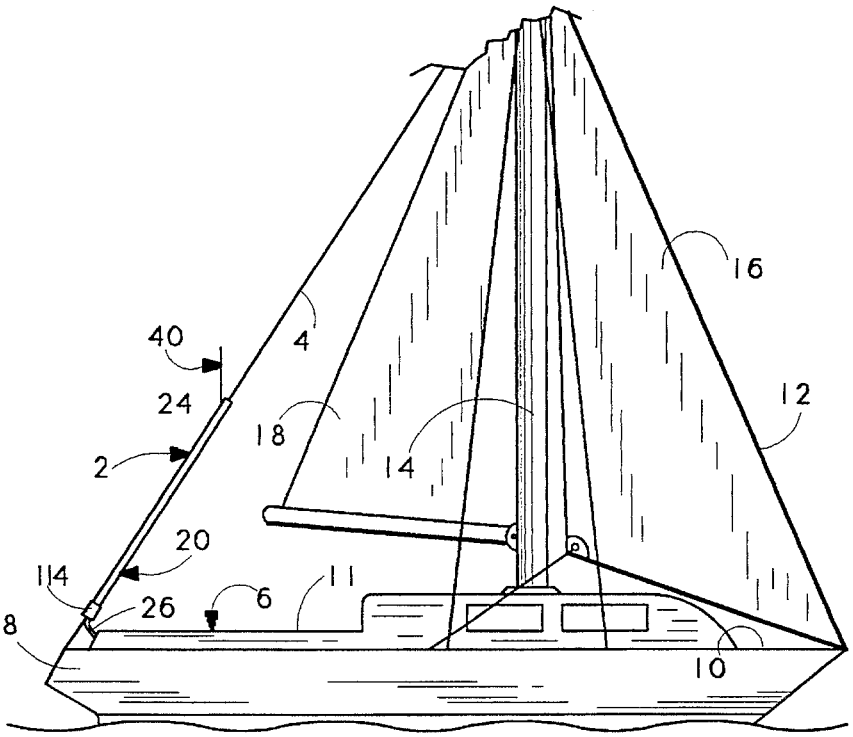
FIG. 1 is a fragmentary lateral elevation of a sailboat equipped with a marine VHF antenna in accordance with the invention.

With reference in detail to the drawings wherein identical parts are identically labeled, the VHF antenna system 2 of the invention is mounted on the backstay 4 of sailboat 6 which typically includes hull 8, deck 10, cockpit 11, forestay 12, mast 14, jib 16 and mainsail 18.

The VHF antenna system 2 comprises an elongated flexible plastic extrusion 20 with a peripheral surface 22, an upper end portion 24, a lower end portion 26 and a main body portion 28 integral with the end portions.

Figure 2:
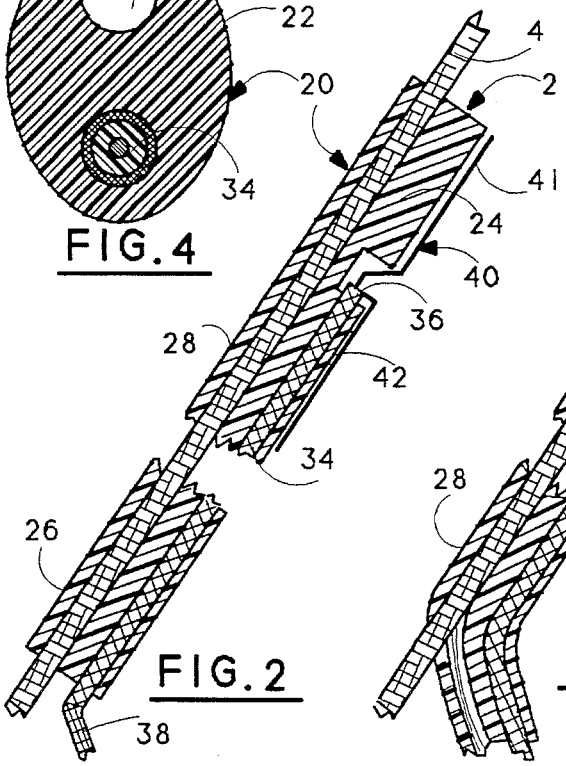
FIG. 2 is a fragmentary, lateral, sectional view of a basic embodiment of a VHF antenna of the invention in place on the backstay of a sailboat.
Figure 3:
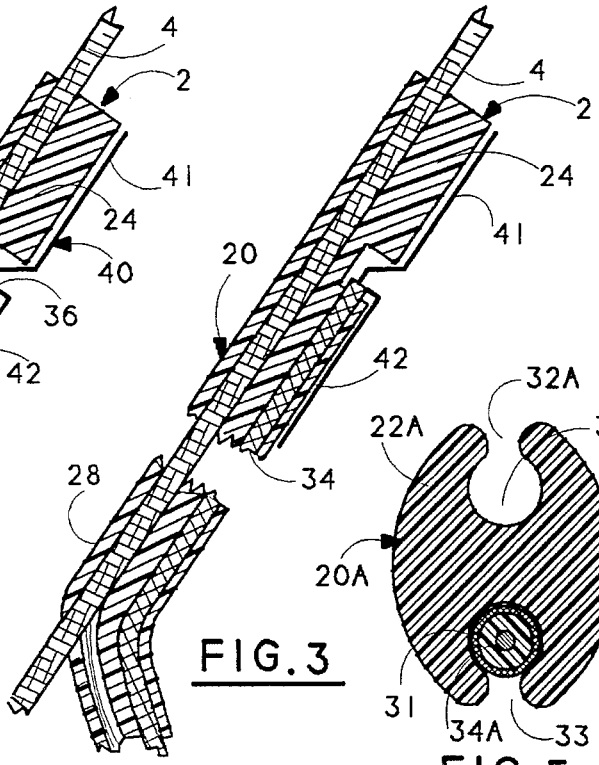
FIG. 3 is a fragmentary, lateral, sectional view similar to FIG. 2 showing the antenna being installed on the backstay.
Figure 5:
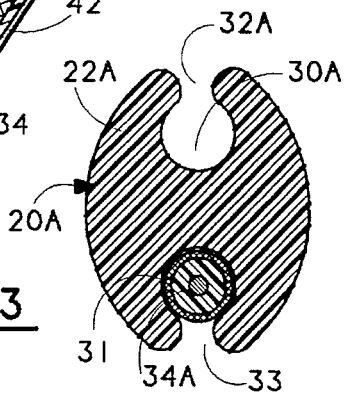
FIG. 5 is an enlarged sectional view of a second form of elongated extrusion of the invention.
Figure 6:
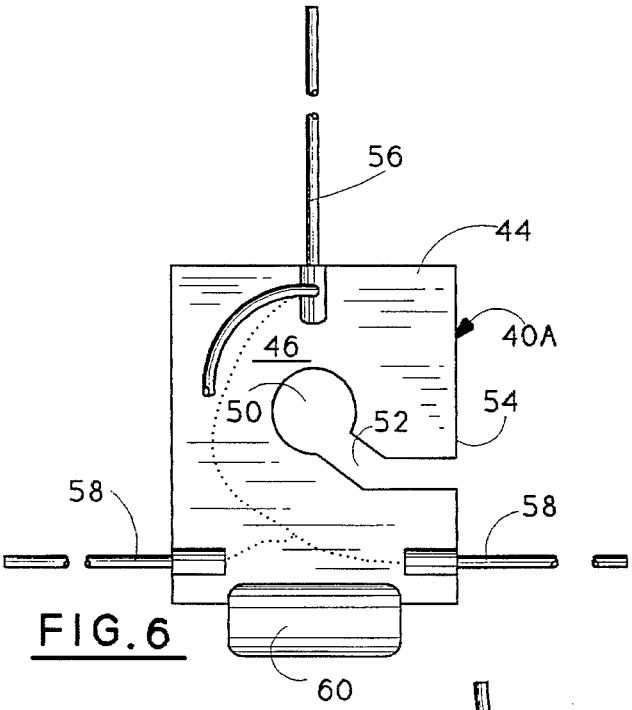
FIG. 6 is a fragmentary lateral elevational view of a first embodiment of a whip radiation unit of the new form of marine VHF antenna of the invention.
Figure 7:
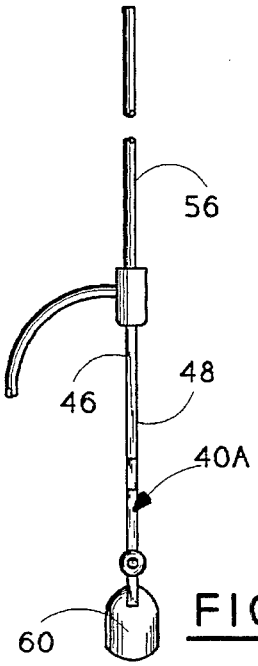
FIG. 7 is a view corresponding to FIG. 6 rotated 90™ about the vertical axis.

The extrusion 20 has a first internal longitudinal cylindrical channel 30 of substantially uniform diameter extending substantially along the entire length of the extrusion. A first longitudinal opening 32 corresponding in length to the first channel extends through the peripheral surface 22 into the channel 30. The width of the opening 32 less than the diameter of the channel 30 which is large enough to snugly enclose (see FIG. 2) the backstay 4.

The extrusion 20 extends along and is supported upon the backstay 4 since the channel 30 encircles the backstay. As shown in FIG. 1, when properly positioned on the sailboat 6, the lower end portion 26 located proximal of the deck 10 and the upper end portion located distal of the deck.

A coaxial cable 34 extends internally within the extrusion 20 along the length thereof and has an upper end 36 and a lower end 38. In the first embodiment shown in FIG. 2, the cable 34 is formed during extrusion as an integral part of the extrusion 20.

Figure 4:
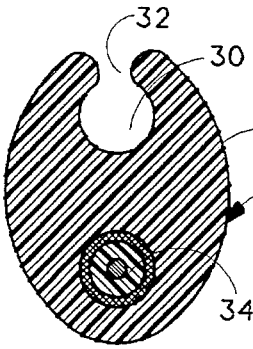
FIG. 4 is an enlarged sectional view of a first form of elongated extrusion of the invention.

In the second embodiment shown in FIG. 4, the extrusion 20A is formed with a first channel 30A and its side opening 32A plus a second channel 31 which substantially mimics the first channel 30 in diameter and length with its side opening 33. In this embodiment, a separate coaxial cable 34A is threaded into channel 31 before or simultaneously with the installation of the extrusion 20A onto the backstay 4 as explained in more detail below.

In all embodiments of the antenna systems of the invention, a VHF radiation unit 40 is supported as shown in FIG. 1 along the backstay 4 at least in part by the upper end portion 24 of extrusion 20 and the VHF radiation unit 40 is electrically connected to the upper end 36 of the coaxial cable 34. In a basic configuration, the unit 40 consists of a pair of dipole elements 41 & 42 carried by the upper end portion 24 of the extrusion 20. Typically, the elements 41 & 42 will be ¼ wavelength long, but may be shortened by coiling or by use of loading coils.

Figure 8:
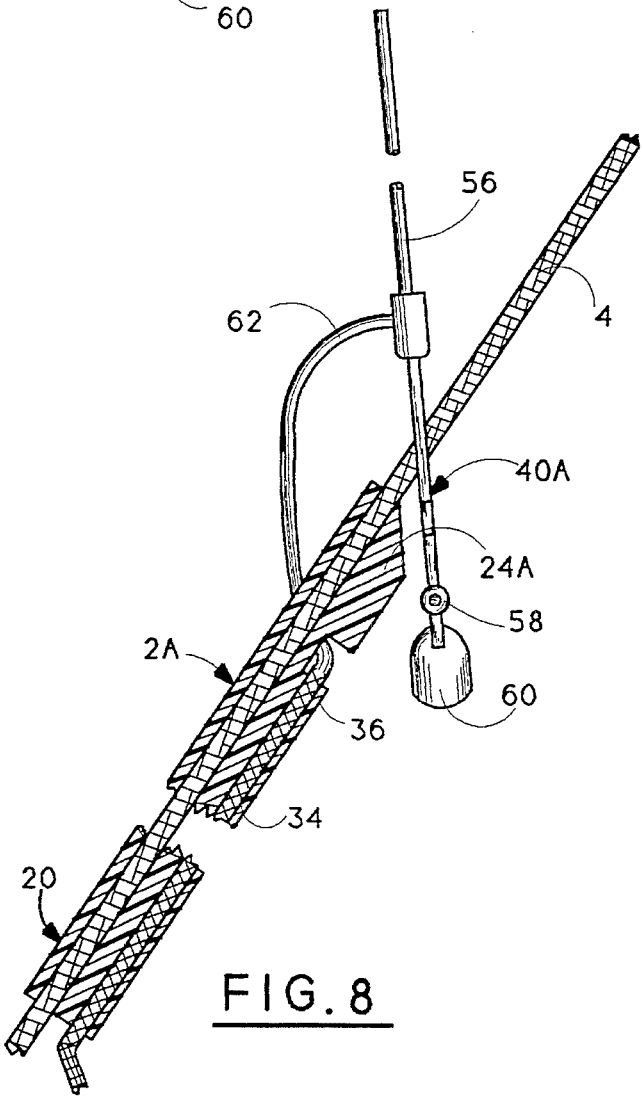
FIG. 8 is a fragmentary, lateral, sectional view of a the embodiment of a VHF antenna of the invention comprising the whip radiation unit of FIG. 6 in place on the backstay of a sailboat.
Figure 9:
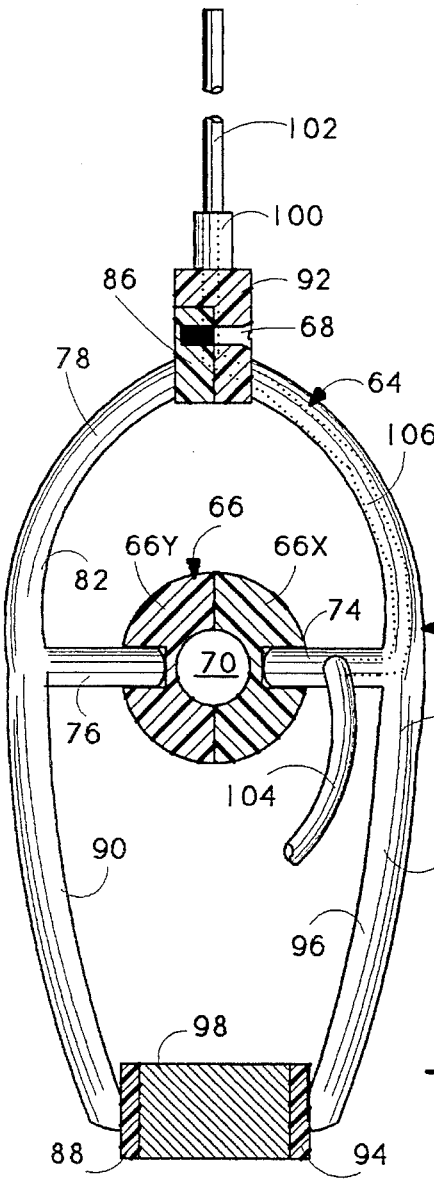
FIG. 9 is a fragmentary lateral elevational view of a second embodiment of a whip radiation unit of the new form of marine VHF antenna of the invention.
Figure 10:
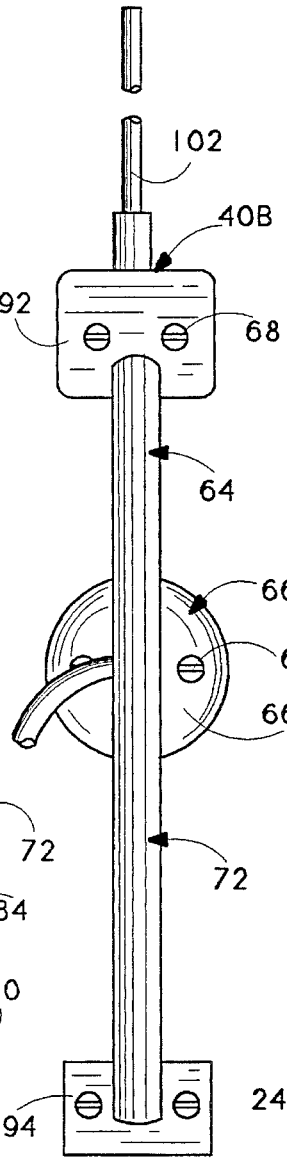
FIG. 10 is a view corresponding to FIG. 9 rotated 90™ about the vertical axis.

In a second embodiment of the antenna system 2A, the VHF radiation unit 40A comprises a plate 44 defined by first and second parallel surfaces 46 & 48 and has a central circular opening 50 extending through both such surfaces. The plate 44 further contains an entrance slot 52 through a vertical sidewall 54 to permit the backstay 4 to extend through the circular opening 50 whereby the weight of the radiation unit 40A is slideably supported by the backstay 4 and the upper end portion 24A of the extrusion 2A prevents the radiation unit 40A from sliding down the backstay as seen in FIG. 8.

The plate 40A has a columnar radiation element 56, e.g., a slender emitter wand, extending therefrom parallel to the surfaces 46/48. Also, counterpoise elements 58 extend laterally and a counterweight 60 depends from the plate.

The radiation element 56 is electrically connected to the upper end 36 of the coaxial cable 34 by lead 62.

In a third embodiment of the antenna system 2B, the VHF radiation unit 40B is supported by a gimbal device 64.

The gimbal device 64 comprises a base member 66 made of two mating parts 66X & 66Y fixed together with removable fasteners 68.

Figure 11:
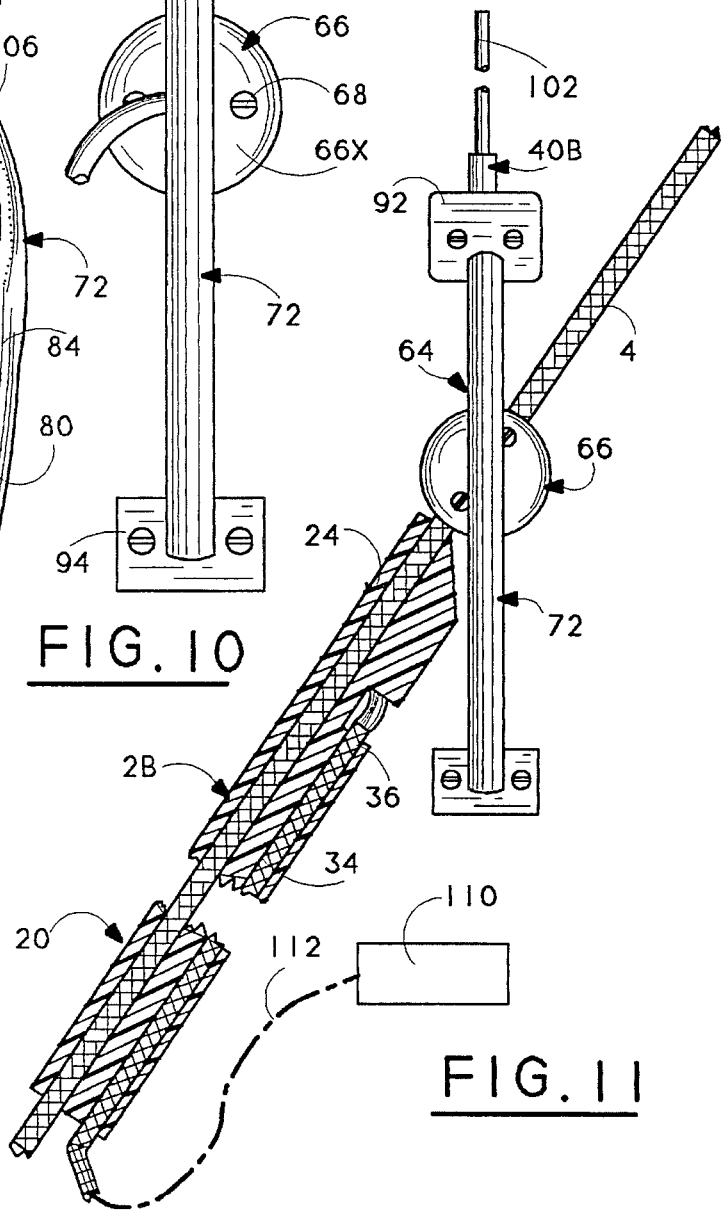
FIG. 11 is a fragmentary, lateral, sectional view of a the embodiment of a VHF antenna of the invention comprising the whip radiation unit of FIG. 9 in place on the backstay of a sailboat.

There is a longitudinal bore 70 through the base member 66 of diameter slightly larger than the diameter of the backstay 4 through which the backstay extends, as shown in FIG. 11, to permit the base member 66 freely to rotate about the longitudinal axis of the backstay 4.

The gimbal device 64 further includes a cage 72 comprising with a pair of central pivots 74 & 76, an upper lever portion 78 and a lower lever portion 80.

The cage is formed of two mating parts 82 & 84 fixed together by fasteners 68. The part 82 has a top lug 86 and bottom lug 88 joined by spanner 90 while part 84 has a top lug 92 and bottom lug 94 joined by spanner 96. Lugs 88 and 94 carry a counterweight 98, e.g., a lead casting, held between them by the fasteners 68.

The top lug 92 has an integral nib 100 from which extends columnar radiation element 102 which is electrically connected to the upper end 36 of coaxial cable 34 by the flexible lead 104 with its extension 106 molded into the pivot 74, spanner 96 and top lug 92. Advantageously, the spanners 90 & 96 can be made of metal and be grounded to the external sheath of the coaxial cable in order to serve as counterpoises for the radiation wand 102.

The new VHF antenna systems 2, 2A, 2B, etc. of the invention can be installed on a sailboat by a person standing on the deck thereby avoiding the trouble and hazard of going aloft, removing a mast, or other hassles encountered with prior known installations. Thus, a person who has been provided by the invention with an elongated flexible plastic extrusion 20 and a VHF radiation unit such a the gimballed unit 40B, begins by mounting the VHF radiation unit on the backstay 4 by manipulation from the deck to permit it to slide along the backstay without falling off. This would comprise placing the pans 66X and 66Y around the backstay 4 and connecting them with the fasteners 68. The cage would then be installed by inserting cage pivots 74 & 76 into the assembled base 66, fastening lugs 86 and 92 together and fastening lugs 88 and 94 to weight 98. As thus assembled, the radiation unit 40B would be captured on the backstay 4, but will be free to slide along and rotate about it.

Then, the VHF radiation unit 40B is electrically connected to the upper end 36 of the coaxial cable 34 of the antenna system 2B. Obviously, the pan 72 could be provided in accordance with the invention connected to the coaxial cable as supplied by the factory or, if supplied separately, the electronic connection can be made before assembly of unit 40B on the backstay.

Next, the extrusion 20 is installed proximal of the VHF radiation unit 40B on the backstay 4 by threading the backstay progressively into the first longitudinal opening 32 so the backstay is progressively enclosed by the first channel 30. This threading operation is continued while simultaneously pushing the VHF radiation unit 40B up the backstay 4 by the upper end portion 24 of the extrusion until the first channel of the extrusion is completely filled with the backstay.

The installation is completed by electrically connecting the lower end 38 of the coaxial cable 34 to a VHF transceiver 110, e.g., a battery powered, hand held transceiver (not shown), advantageously by a flexible lead 112.

An elective additional step in the installation, is the application of clamp means 114 to the lower end portion of the extrusion 20 to prevent further movement of the extrusion along the backstay or, alternatively, placement of a clamp or the like on the backstay 4 just below the extrusion 20 to ensure the extrusion remains at the desired height on the backstay.

The embodiments of the invention in which an exclusive property or privilege is claimed are defined as follows:

1. In a VHF antenna system for a sailboat including a mast, deck and backstay, the improvement which comprises:

an elongated flexible plastic extrusion defined by a peripheral surface, an upper end portion, a lower end portion and a main body portion integral with said end portions, said extrusion containing a first internal longitudinal cylindrical channel of substantially uniform diameter extending substantially along the entire length of said extrusion, a first longitudinal opening corresponding in length to said first channel through said peripheral surface into said channel, the width of said first opening being less than the diameter of said first channel, a coaxial cable extending internally of said extrusion along the length thereof and having an upper end and a lower end, said extrusion extending along and being supported upon said backstay by said first channel encircling said backstay with said lower end portion located proximal of said deck and said upper end portion located distal of said deck, a VHF radiation unit supported along said backstay at least in part by said upper end portion of said extrusion, and said VHF radiation unit being electrically connected to said upper end of said coaxial cable.

2. The antenna system of claim 1 wherein said extrusion contains a second internal longitudinal cylindrical channel that substantially mimics said first channel in diameter and length, a second longitudinal opening corresponding in length to said second channel through said peripheral surface into said second channel, the width of said second opening being less than the diameter of said second channel, and a major portion of said coaxial cable being contained in said second channel.

3. The antenna system of claim 1 wherein said coaxial cable constitutes an integral part of said extrusion.

4. The antenna system of claim 1 wherein said VHF radiation unit consists essentially of a pair of dipoles carried by said upper end portion of said extrusion.

5. The antenna system of claim 1 wherein said VHF radiation unit comprises a plate defined by first and second parallel surfaces having a central circular opening extending through both said surfaces, said backstay extending through said circular opening whereby the weight of said radiation unit is slideably supported by said backstay and said upper end portion of said extrusion prevents said radiation unit from sliding down said backstay, said plate having a columnar radiation element extending therefrom parallel to said surfaces.

6. The antenna system of claim 5 wherein counterpoise elements extend from said plate.

7. The antenna system of claim 5 wherein a counterweight depends from said plate.

8. The antenna system of claim 1 wherein said VHF radiation unit is supported by a gimbal device.

9. The antenna system of claim 8 wherein said gimbal device comprises a base member consisting of two mating parts fixed together with removable fasteners, a longitudinal bore through said base member of diameter slightly larger than the diameter of said backstay with said backstay extending therethrough permitting said base member freely to rotate about the axis of said backstay, a cage defined by a pair of central pivots, a upper lever portion and a lower lever portion, a columnar radiation element extending from said upper lever portion and a counterweight carried by said lower lever portion.

10. The antenna system of claim 9 wherein said cage is formed of two mating parts fixed together by fasteners.

11. The antenna system of claim 9 wherein said base member consists of two hemispheric elements each containing a bore into which said central pivots extend.

12. In a VHF radio installation aboard a sailboat including a mast, deck, and backstay the improvement which comprises:

a VHF antenna system and a VHF transceiver, said VHF antenna system including, an elongated flexible plastic extrusion defined by a peripheral surface, an upper end portion, a lower end portion and a main body portion integral with said end portions, said extrusion containing a first internal longitudinal cylindrical channel of substantially uniform diameter extending substantially along the entire length of said extrusion, a first longitudinal opening corresponding in length to said first channel through said peripheral surface into said channel, the width of said first opening being less than the diameter of said first channel, a coaxial cable extending internally of said extrusion along the length thereof and having an upper end and a lower end, said extrusion extending along and being supported upon said backstay by said first channel encircling said backstay with said lower end portion located proximal of said deck and said upper end portion located distal of said deck, a VHF radiation unit supported along said backstay at least in part by said upper end portion of said extrusion, said VHF radiation unit being electrically connected to said upper end of said coaxial cable and said VHF transceiver being electrically connected to said lower end of said coaxial cable.

13. The VHF radio installation of claim 12 wherein said transceiver is a battery operated, hand held transceiver that is electrically connected to said lower end via flexible coaxial lead.

14. In a method of assembling a VHF antenna for a sailboat including a mast, deck and backstay, the improved combination of steps which comprise:

providing an elongated flexible plastic extrusion defined by a peripheral surface, an upper end portion, a lower end portion and a main body portion integral with said end portions, said extrusion containing:

a first internal longitudinal cylindrical channel of substantially uniform diameter extending substantially along the entire length of said extrusion, and a first longitudinal opening corresponding in length to said first channel through said peripheral surface into said channel, the width of said first opening being less than the diameter of said first channel, and a coaxial cable extending internally of said extrusion along the length thereof and having an upper end and a lower end, providing a VHF radiation unit, mounting said VHF radiation unit on said backstay by manipulation from said deck to permit it to slide along said backstay without falling off, electrically connecting said VHF radiation unit to said upper end of said coaxial cable, installing said extrusion behind said VHF radiation unit on said backstay by threading said backstay progressively into said first longitudinal opening so said backstay is progressively enclosed by said first channel, and continuing said installing while simultaneously pushing said VHF radiation unit up said backstay by said upper end portion of said extrusion until said first channel of said extrusion is completely filled with said backstay.

15. The method of claim 14 which includes the additional step of applying clamp means to said lower end portion of said extrusion to prevent further movement of said extrusion along said backstay.

16. The method of claim 14 which includes the additional step of electrically connecting said lower end of said coaxial cable to a VHF transceiver.

* * * * *